US005687527A

United States Patent [19]

Bikard et al.

[11] Patent Number: 5,687,527

[45] Date of Patent: Nov. 18, 1997

[54] SUSPENDED CEILING FOR CLEANROOMS

[75] Inventors: Jean-Luc Bikard, Cicero, N.Y.; Martin Craig Helmus, Grandville, Mich.

[73] Assignee: Clestra Cleanroom (S.A.), Strasbourg, France

[21] Appl. No.: 657,628

[22] Filed: May 30, 1996

[30] Foreign Application Priority Data

Feb. 22, 1996 [FR] France ..... 96 02371

[51] Int. Cl.[6] ..... E04B 9/00

[52] U.S. Cl. ..... 52/506.08; 52/506.06; 52/665; 454/293; 403/230

[58] Field of Search ..... 52/506.06, 506.08, 52/509, 665; 454/231, 238, 248, 293, 294, 295, 296, 297; 403/230, 256, 257, 258

[56] References Cited

U.S. PATENT DOCUMENTS

| | | | |
|---|---|---|---|
| 3,375,029 | 3/1968 | Frye et al. | 403/230 |
| 3,429,601 | 2/1969 | Bremers | 403/230 |
| 3,556,569 | 1/1971 | Bruhn | 403/230 X |
| 3,655,961 | 4/1972 | Hover | 454/293 X |
| 3,835,614 | 9/1974 | Downing, Jr. | 454/293 X |
| 4,663,911 | 5/1987 | Gracia | 52/506.06 |
| 4,730,428 | 3/1988 | Head et al. | 52/506.08 X |
| 4,944,129 | 7/1990 | Hartleif | 52/506.08 |
| 4,986,050 | 1/1991 | Brunetti et al. | 52/506.08 |
| 5,033,247 | 7/1991 | Clunn | 52/506.08 |
| 5,263,290 | 11/1993 | Gardner | 454/293 X |
| 5,454,756 | 10/1995 | Ludwig | 454/293 X |
| 5,533,640 | 7/1996 | Jolly | 52/665 X |

FOREIGN PATENT DOCUMENTS

| | | | |
|---|---|---|---|
| 2903824 | 8/1979 | Germany | 403/230 |
| 1579941 | 11/1980 | United Kingdom | 403/230 |

*Primary Examiner*—Carl D. Friedman
*Assistant Examiner*—W. Glenn Edwards
*Attorney, Agent, or Firm*—Abelman, Frayne & Schwab

[57] ABSTRACT

Suspended ceiling structure for cleanroom comprising a pressurized plenum, the lower face thereof is defined by filter plates supported by a metallic structure having the shape of an horizontal grid, comprising extrusions (P1, P2, P3) crossing at a right angle, said extrusions (P1, P2, P3) having upper channels associated in such a manner that they form a continuous channel around each mesh of the grid and they form a support for a filter plate (13, 13'), said channels (15, 15') being filled with a material in which dips a peripheral support (14, 14') for said filter plate (13, 13') to assure the sealing between the plenum and the volume beneath the ceiling structure, characterized in that each extrusion (P1, P2, P3) comprises at least one horizontal lateral groove (3), upon its full length and having the shape of a slide (2) having at each end housings (4) provided to cooperate with fixation means (5, 6, 7) of a perpendicular extrusion, said fixation means (5, 6, 7,) cooperating also with said slide (2) facing said perpendicular extrusion, in front of a slot (8) of the upper edge of the same, which results in the continuous character of the upper channel (15, 15') of each mesh.

12 Claims, 4 Drawing Sheets

SUSPENDED CEILING FOR CLEANROOMS

This invention relates to new and useful improvements in suspended ceillings generally used in "cleanrooms" to ventilate the same with completely sterile air. Said cleanrooms are extensively used in various fields such as pharmaceutical or biological plants, high precision mechanical and electronical plants and rooms containing computers.

Such suspended ceilings generally comprise a closed volume usually called "plenum" supplied with pressurized air and the bottom wall of which is made of a plurality of horizontal plates comprising high efficiency filter material, said plates being supported by a generally metallic structure generally called grid assembly, which is connected to the room walls, to provide the fixation of said plenum.

The filter plates are resting upon an horizontal network or grid comprising extrusions crossing at a 90° angle, said extrusions having upwardly opened channels and arranged together with a view to form a continuous channel around each mesh of the grid and providing a support for each filter plate.

Said filter plates comprise a peripheral flange dipping in a sealant, preferably liquid or gel, poured into said channels to provide a seal between said plenum and the volume beneath the ceiling structure.

It is known to use such continuous channels filled with a sealing material, as described for example in U.S. Pat. Nos. 4,683,699, 4,986,050 and 4,710,208 and in EP 0 530 976.

The use of a sealing gel in a grid structure has still specific drawbacks such as the difficulty to provide a sealing to the channels themselves, specially in the crossing area. Such a problem is related with the connection between the structure forming extrusions, and also with the connection of the structure to the ceiling.

Some connection systems comprise a specific extrusion type and a specific sealing system. As an example, in U.S. Pat. No. 4,683,699, each connection mode (in cross, in T, in U) needs a specific element engaging the upper channel of the extrusion which is specially designed therefor. The sealing efficiency is depending on said engagement, it needs an excellent adjustment of the elements.

Similarly, in U.S. Pat. No. 4,710,208, the crossing connections are obtained by using additional parts housed in the upper channels and adjusted in the extrusions to which they are bolted. Additional gaskets are provided at the horizontal faces of said parts, more precisely at the points where the extrusions meet. A similar assembly is disclosed in U.S. Pat. No. 4,986,050.

A connection disclosed in EP 0 530 976 has for its main feature that, due to their specific shape (in cross, in T, in U), it does not comprise any part mating the upper channels. The connection parts are simply brackets bolted into the extrusions to be connected.

However, in all those prior structures, the filter supporting grid is difficult to build and needs a high degree of skill to assure a correct sealing of the upper channels.

A first difficulty in carrying out this building operation is due to the fact that the connection between the extrusions is made at their upper faces level. Not only the mounting steps are difficult but also the survey upon an existing ceiling is also difficult to carry out.

Moreover, the connection means are not used at the precise contact area between two given extrusions and they involve strains, the effects of which (direction, orientation . . . ) are not directly used to bring said surfaces closer to increase the sealing condition or to increase the efficiency of the sealing joints. As an example, bolting a part having a cross shape involves vertical efforts only and is of no consequence upon the gaskets placed between the upper channels of the extrusions and said cross parts. It is the operator who has to position said gaskets in the best possible manner.

If no gaskets are used, the allowed tolerances are such that the product becomes very costly and also difficult to mount in place.

Generally, the systems disclosed in the prior art documents such as cited above are complicated and require skilled operators. Additionally, to assure a total sealing, most systems of that type of ceilings for cleanrooms are making use of a pasty material of the polyurethane or silicone type. For safety reasons, such as the gas evolving from said materials, they are frequently not desired.

The suspended ceiling according to this invention overcomes the above drawbacks. It provides firstly a new connection between extrusions which is simple and easy to carry out, and which increases the sealing efficiency of the connection.

To this effect, the extrusions used in the structure of suspended ceiling of the invention, which are of the type comprising upwardly open channels, forming a continuous channel at the periphery of each mesh of the grid, and forming supports receiving a sealant in which the filter plates are placed, are such that each extrusion has at least one horizontal side groove along its full length, said groove being shaped as a slide, said groove ending by housings designed to cooperate with fixation means to a first perpendicular extrusion, said fixation means cooperating also with a second perpendicular extrusion facing said first perpendicular extrusion, by way of a slot in the upper edge of the same, providing the continuous character of the upper channel of each mesh.

Said fixation means can be reached from the side faces of the extrusion and it has for double purpose (a) to connect one extrusion to a perpendicular extrusion and (b) to bring closer and tighten both extrusions one towards/against the other, since it acts along the axis of one of said extrusions as it will be described hereafter.

In such a configuration, there is no sealing problem except in said slot area, since it is the connecting area of the channels of the perpendicular extrusion.

According to this invention, a solid joint having the shape of said slot is placed between two connected perpendicular extrusions along said slot.

Said joint is more efficient due to the compressing action resulting from the closer tightening of said extrusions.

The extrusions have slides of T cross-section, each slide being cut into a side face of the extrusion along the leg of said T. In this configuration, the end housing of each slide is a hole punched through the extrusion, perpendicularly to its axis, and having a diameter just larger than the groove width.

Preferably, the connection means consists in a threaded rod or screw placed longitudinally along the slide of one extrusion, and screwed in two nuts at its ends, a first nut being inserable from the exterior and blocked against rotation and against translation with regard to the slide axis, the head of the screw being in thrust relationship with said nut, while the second nut is movable only in translation in the slide of a perpendicular extrusion and receives the free end of said screw.

The first nut, in contact with the screw head, is adjustable along at least the surface opposed to said head with regard to facing surfaces of said end housing.

According to a first modification, said first nut is of cylindrical shape and has a threaded hole perpendicular to its axis.

According to a second modification, said first nut is of partially cylindrical shape and has a flat part engaging the threaded rod, with a thrust effect.

The second nut, movable in translation in the slide of a perpendicular extrusion is of plane elongated shape, it has a cross section dimension comprised between the groove width and the slide width and it has a threaded hole to accomodate the end of the connection means screw.

The mounting of the ceiling structure of the invention is simple and easy: the connecting means comprising the threaded rod and both nuts placed at its ends is inserted in the groove of the extrusion comprising the slot in face of which has to be connected a perpendicular extrusion.

In fact, it needs only to insert in the slide the nut of the screw free end. Then the assembly is slided until the slot location and the second nut is inserted into the housing provided in the slide of the second extrusion. The threaded rod enters thus the slide section situated between said housing and the extrusion end along an axial direction.

Both nuts being blocked against rotation, and the first nut close to the screw head being additionally blocked in translation, tightening of the screw results in approaching the second nut towards the internal surfaces of the slide defining the groove, and therefore approaching each extrusion towards the other. As long as said tightening is not yet completed, it needs only to insert the joint at the edge of the upper slot to provide a sealing as efficient as the connection is tightened. Preferably, said joint is pre-sticked at an extrusion end before the final mounting operation.

According to a preferred configuration, the slot and the corresponding solid joint are of V shape in cross section.

From the above description of the invention, it is clear that the ceiling system can be installed without difficulty and very rapidly. It is of very flexible use, particularly in case of replacement of one or several extrusions.

It obviates the use of a specific additional part to create a connection between two extrusions, but makes use of an usual connecting element, easy to place in one or two locations of the extrusion.

Finally, the solid joint in the upper area of the extrusions provides an aesthetical advantage resulting from the fact that no joint is visible from the room equipped with this ceiling.

All those advantages are the result from the specific concept of the extrusions acording to the invention, i.e. extrusions having the groove and end housing system.

The invention will now be described more in detail with reference to the attached drawings in which.

Figure 4A:
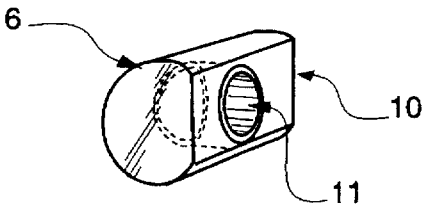
Figure 4B:
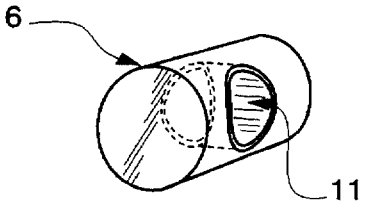
Figure 5:
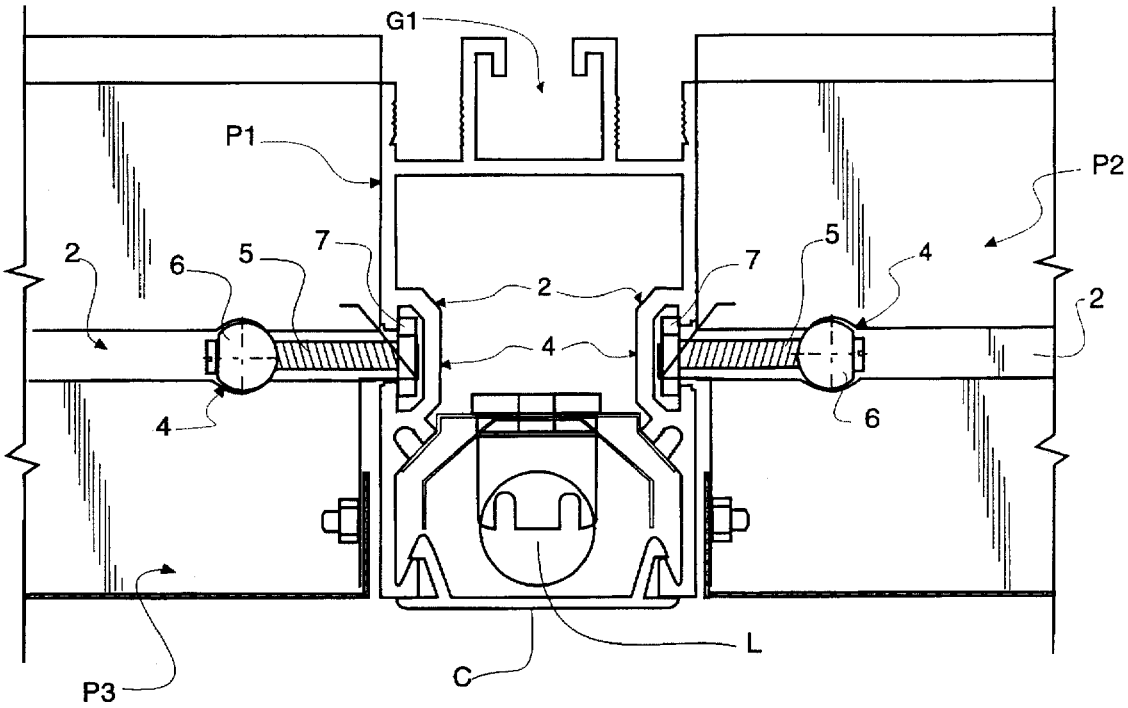
Figure 6:
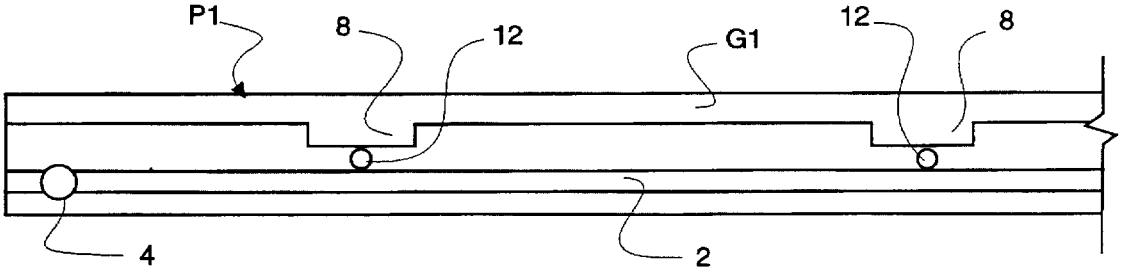
Figure 7:
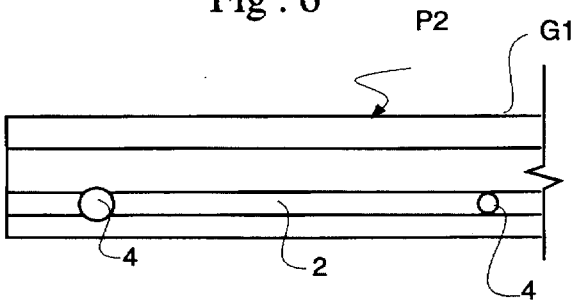
Figure 8:
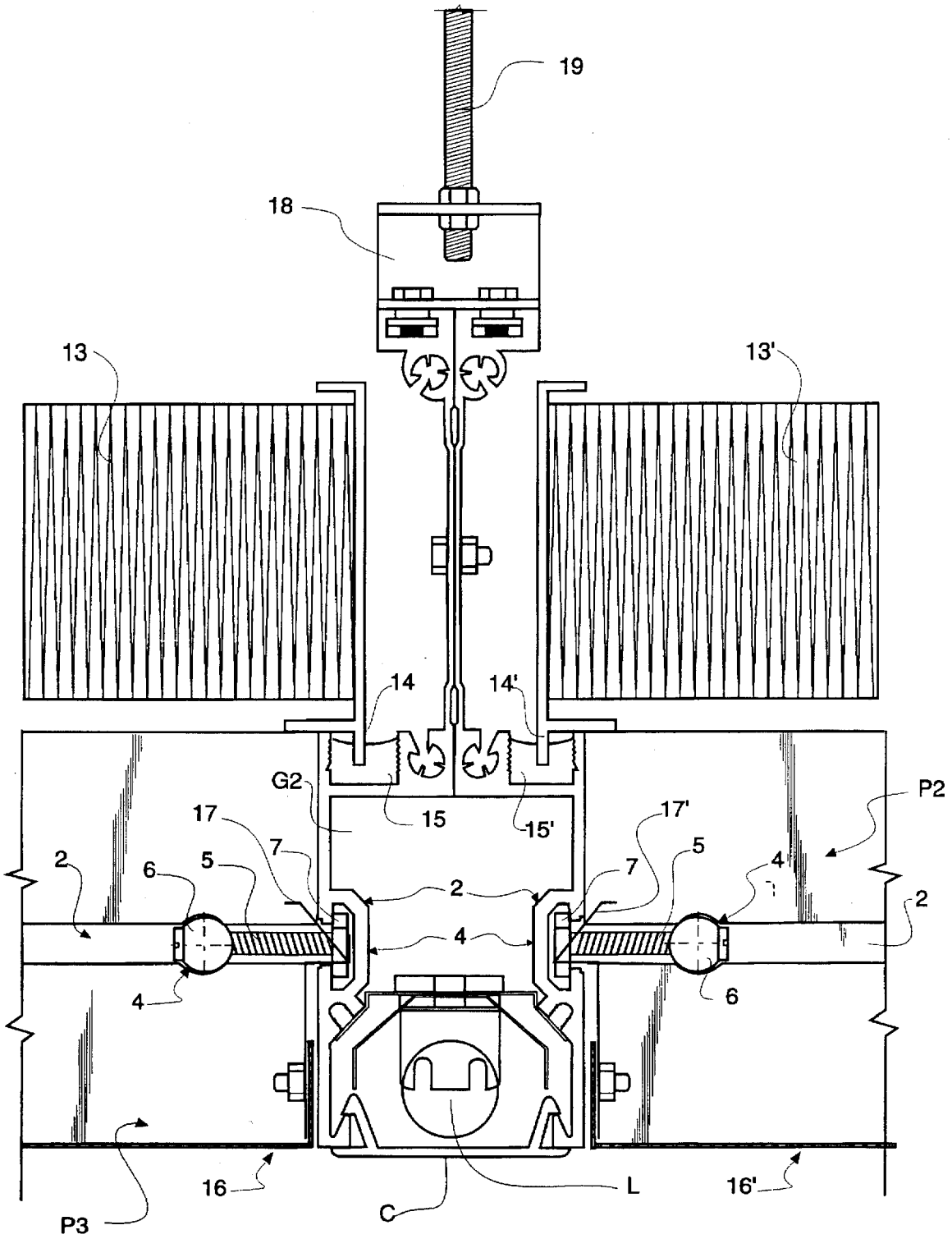

FIGS. 4*a* and 4*b* are perspective views of two modifications of the first nut close to the screw head;

FIG. 5 is a cross section of an extrusion equipped with a lighting tube, connected with two symmetrical perpendicular extrusions;

FIG. 6 is a side view of a section of a longitudinal extrusion;

FIG. 7 is a side view of a section of a shorter transversal extrusion;

FIG. 8 shows an assembly comprising two perimetral extrusions connected to two perpendicular extrusions and comprising a filter plate.

Figure 1:
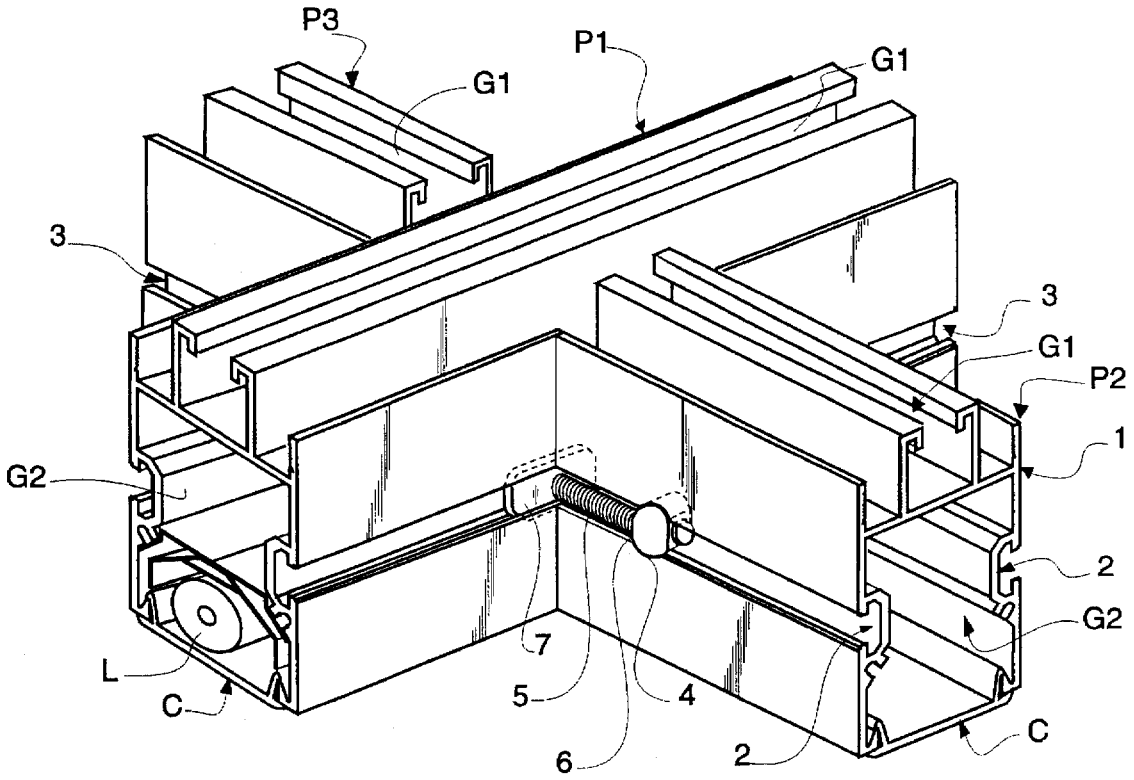
FIG. 1 is a general perspective view of an extrusion crossing according to the invention.

Referring first to FIG. 1, it is shown an assembly of three extrusions according to the invention in the area where said extrusions are crossing and connected by the system of the invention.

To simplify the description, it is considered that the central extrusion P1 is a longitudinal extrusion whereas extrusions P2 and P3 are transversal extrusions. Such a configuration is preferred, since a long extrusion P1 is connected to two shorter extrusions P2, P3. Different configurations are obviously possible, the connecting system of the invention being the same.

In the following will be described the extrusions per se and their connecting system, being understood that the means to suspend this ceiling structure to the ceiling slab itself and the attachments equipping the lower part, are not a part of the invention.

In this figure, said suspensing means are generally installed in upper channels G1, whereas lower channels G2 can support attachments such as lighting tubes L as shown in P1, and/or covers C, as shown in P2.

Each extrusion 1 according to the invention has lateral slides 2 along the same common axis, as said extrusion along its full length, and opening to the exterior by a central groove 3, having the same axis.

At the corner between P1 and P2 is shown the fixation means according to the invention. This means cooperates with a housing 4 of generally circular shape, cut close to the end of extrusion P2 and clearly shown in FIG. 3.

As shown, said fixation means extend substantially axially along P2, so that the tightening efforts are therefore exerted in the plane of the ceiling structure. Said fixation means comprise a screw or threaded rod 5 to which are associated two nuts 6, 7 respectively at both ends of said rod 5.

Each nut 6, 7 rests againts a surface of extrusion P2, and P1 which contains it, and exerts an effort in opposition to the tightening, which results in a tight connection between P1 and P2.

Figure 2:
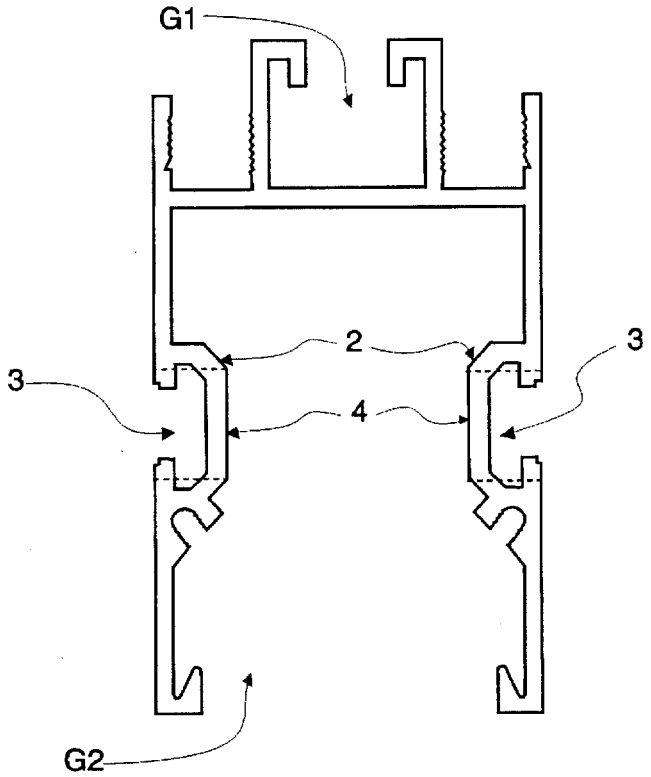
FIG. 2 is a cross section view of an extrusion.

FIG. 2 shows a cross section of an extrusion of the P1, P2 type, to make clear the precise shape of slides 2 and of grooves 3. In this configuration, the housings 4 are cut out the opening edges and punched through the bottom of slides 2. This forms a double rest surface nuts 6, as it will be explained more in detail hereinafter. Such a cut/punched housing is very easy to work, which is an economical advantage of the invention.

Figure 3:
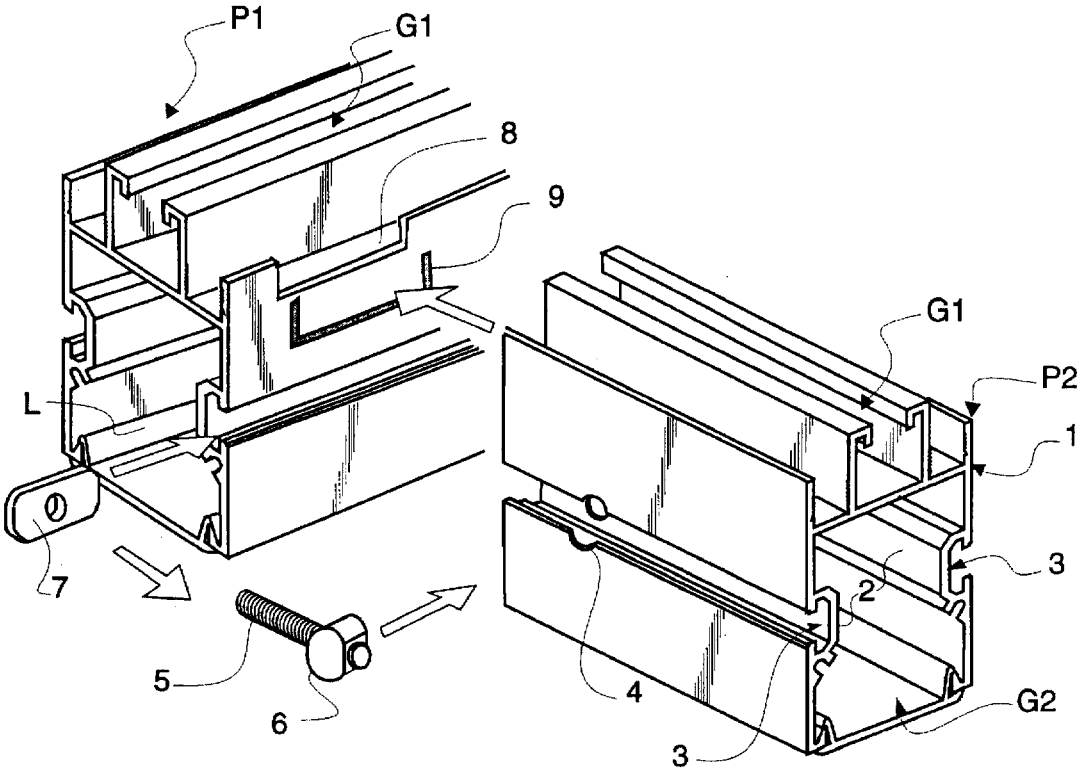
FIG. 3 is an exploded view of assembly of two perpendicular extrusions.

In the exploded view of FIG. 3, the same elements appear clearly in the disassembled condition. The slot 8 in the upper edge of extrusion P1 and the solid joint 9 are visible on this figure.

The second nut 7 has such a configuration that it has only one freedom degree: it is movable only in translation along groove 2. The shape of this nut 7 is not limited to the rectangular plate as shown but could be more generally of polygonal shape, the only condition being that it limits or even prevents any rotation.

The first nut 6 is close to the other end of threaded rod 5, and has such a shape that is it accomodated in the housing 4. As shown in FIGS. 4*a* and 4*b*, said nut has a generally cylindrical shape with a flat area 10 (FIG. 4*a*) or even without such a flat area (FIG. 4*b*), and it has also a threaded hole 11. Depending on specific cases, the head or end of the rod or screw 5 can be worked to facilitate its insertion into a chamfrein of the threaded hole 11 (FIG. 4*b*) or be rounded and rest against the flat area 10 (FIG. 4*a*).

Said first nut 6 is restrained against any rotation along the rod 5 axis, and against translation in the slide 2 of the corresponding extrusion. Therefore, a simple tightening of the screw 5 results in bringing both nuts 6, 7 closer, which abut against the thrust surfaces of their respective extrusions, and act one towards the other. The solid joint 9 is threfore kept pressed between the upper end of extrusion P2 and the upper edge of slot 8 of extrusion P1.

FIG. 5 shows the assembly of FIG. 1, in front view, the middle extrusion P1 being equipped with a lighting tube L, with a cover C. The nut 6 shown is of the FIG. 4*a* type, with a spherical headed threaded rod 5.

The assembly screw 5/cylindrical nut 6/flat nut 7 is preferably mounted after loose pre-assembly. The assembly is slided along until the tightening position, the screw 5 and the nut 6 being housed in the extrusion, then they are tightened.

It is also possible to proceed in two steps: the nut 7 is firstly positioned close to slot 8, and then the assembly screw 5/nut 6 is screwed therein and the remaining of the operation being the same as above.

FIGS. 6 and 7 show long extrusions P1 and short extrusions P2 as viewed laterally. In the first, the slots 8 are regularly distributed above ports 12 provided for passing the technical connections such as electrical wires from long extrusions P1 to transversal extrusions P2, P3.

FIG. 8 shows the assembly of two perimetral extrusions, whereas in the precendent figure, the extrusions are shown in place within the area defined by said extrusions. Said extrusions can be placed along the vertical walls of the room, or can be associated with a similar symmetrical room. All the above functions are fulfilled in the same manner as above and it is not necessary to describe then in detail. The purpose of this figure is to show the filter plates as they are installed and also a possible manner to attach the system to the ceiling slab.

Said plates 13, 13' are supported by peripheral supports 14, 14' dipped into channels 15, 15' which are shown in the above figures, on each side of the upper groove G1, which does not exist here. This ceiling structure has a lower surface completely plane, resulting from the grids 16, 16' which can be clipsed in the openings 3 by spring elements 17, 17' and from the cover C which is used with all lower channels G2.

The assembly is hanged to the ceiling slab through a suspension support 18, associated in a known manner with a threaded rod 19 by way of nuts.

The configuration shown and described here is a preferred embodiment presented as a non limitative example of the invention, which encompasses all modifications which will appear to the skill in the art and is limited only by the following claims.

We claim:

1. Suspended ceiling structure for cleanroom comprising a pressurized plenum, a lower face thereof defined by filter plates supported by a metallic structure having the shape of a horizontal grid, comprising extrusions (P1, P2, P3) crossing at a right angle, said extrusions (P1, P2, P3) having upper channels (15, 15') associated in such a manner that they form a continuous channel around each mesh of the grid and they form a support for a filter plate (13, 13'), said channels (15, 15') being filled with a material in which is received the lower end of a peripheral skin (14, 14') surrounding said filter plates (13, 13') to assure the sealing between the plenum and the volume beneath the ceiling structure, wherein each extrusion (P1, P2, P3) comprises at least one horizontal lateral groove (3) located in one of the vertical sides thereof, upon its full length and having the shape of a slide (2) and having at each end housings (4) opening to said lateral vertical sides to cooperate with fixation means (5, 6, 7) for affixing each of said extrusions to a perpendicular extrusion, said fixation means (5, 6, 7) also cooperating with a slide (2) of said perpendicular extrusion, which results in the continuous character of the upper channels (15, 15') of each mesh.

2. Suspended ceiling structure according to claim 1, characterized in that a solid joint (9) having the external shape of said slot (8) is placed along said slot (8) between two extrusions (P1, P2,P3) perpendicularly connected.

3. Suspended ceiling structure according to claim 1, characterized in that in the extrusions (P1, P2, P3), said slides (2) have a cross section of T shape, the groove (3) opening in at least one lateral face corresponding to the leg of said T.

4. Suspended ceiling structure according to claim 3, characterized in that said housing (4) at the ends of each slide (2) is a transversal hole directed perpendicularly to the axis of the extrusions (P1, P2, P3), punching the same and the diameter of which is strictly larger than the width of groove (3).

5. Suspended ceiling structure according to claim 4, characterized in that said fixation means comprise a screw (5) placed horizontally within said slide (2) of an extrusion (P1, P2, P3), screwed in two nuts (6, 7,) placed at its ends, the first of said nuts (6) being inserable from the exterior and, once in position, being blocked against rotation and against translation with regard to the axis of said slide (2), the head of said screw (5) resting against said nut (6), whereas the second nut (7) is moveable only in translation within slide (2) of a perpendicular extrusion (P1, P2, P3) and accomodates the free end of said screw (5).

6. Suspended ceiling structure according to claim 5, wherein the first nut (6) in contact with the head of the screw (5) fits in said housing (4) so that at least the surface thereof opposed to said screwhead (5) is fitted in said housing (4).

7. Suspended ceiling structure according to claim 6, characterized in that said first nut (6) is of cylindrical shape and has a threaded hole (11) which passes through it perpendicularly to its axis.

8. Suspended ceiling structure according to claim 6, characterized in that said first nut (6) is of partially cylindrical shape with a flat area (10) used as a contact and thrust surface to the screw head (5).

9. Suspended ceiling structure according to claims 7, characterized in that said second nut (7) which is movable only in translation within the slide (2) of an extrusion is of elongated shape and has a transversal dimension comprised between the width of groove (3) and the width of slide (2), and has a threaded hole (11) provided to accomodate the screw end (5) of said connecting means.

10. Suspended ceiling structure according to claims 8, characterized in that said second nut (7) which is movable only in translation within the slide (2) of an extrusion is of elongated shape and has a transversal dimension comprised between the width of groove (3) and the width of slide (2), and has a threaded hole (11) provided to accomodate the screw end (5) of said connecting means.

11. Suspended ceiling structure according to claim 9, characterized in that said solid joint (9) between two extrusions (P1, P2, P3) perpendicularly connected has a V shape.

12. Suspended ceiling structure according to claim 10, characterized in that said solid joint (9) between two extrusions (P1, P2, P3) perpendicularly connected has a V shape.

* * * * *